US006220938B1

(12) United States Patent
Stocker et al.

(10) Patent No.: US 6,220,938 B1
(45) Date of Patent: Apr. 24, 2001

(54) GRINDING MACHINES

(75) Inventors: Mark Andrew Stocker, West Hunsbury; Matthew James Ball; Dermot Robert Falkner, both of Olney; Peter Vaughan Mawer, Skipton; Paul Martin Howard Morantz, Newport Pagnell, all of (GB)

(73) Assignee: Unova U.K. Limited, Aylosbury (GB)

( * ) Notice: Subject to any disclaimer, the term of this patent is extended or adjusted under 35 U.S.C. 154(b) by 0 days.

(21) Appl. No.: 09/273,058

(22) Filed: Mar. 19, 1999

(30) Foreign Application Priority Data

Mar. 25, 1998 (GB) ..... 9806244
Oct. 1, 1998 (GB) ..... 9821236

(51) Int. Cl.[7] ..... B24B 9/08
(52) U.S. Cl. ..... 451/49; 451/5
(58) Field of Search ..... 451/6, 65, 43, 451/44, 246, 258, 5, 56, 72, 178, 541, 542, 547

(56) References Cited

U.S. PATENT DOCUMENTS 3,364,630 * 1/1968 Rusk et al. ..... 451/541 X
3,562,702 * 2/1971 Celovsky ..... 451/49 X
4,800,686 * 1/1989 Hirabayashi et al. ..... 451/541 X
4,841,676 * 6/1989 Barwasser ..... 451/541 X
4,841,682 * 6/1989 Waelti ..... 451/49
5,533,931 * 7/1996 Imai et al. ..... 451/49 X

* cited by examiner

*Primary Examiner*—David A. Scherbel
*Assistant Examiner*—Anlhony Ojini
(74) *Attorney, Agent, or Firm*—Lee, Mann, Smith, McWilliams, Sweeney & Ohlson

(57) ABSTRACT

A grinding pin (53) for notch grinding is provided. The grinding pin comprises a cylindrical region of formable grinding material and in which is formed a groove (18) for forming a notch. The length of the cylindrical region is such that further grooves (20) can be formed therein as each groove becomes too worn to form a notch.

11 Claims, 5 Drawing Sheets

GRINDING MACHINES

This invention relates to grinding machines and to grinding wheels for use in such machines for grinding notches in the edges of discs such as wafers of silicon for use in the construction of semi-conductor devices, and to methods of grinding edge regions of such discs so as to form notches therein. Since the notches are of relatively small dimensions relative to the size of the wafers, grinding wheels used to form such notches are commonly referred to as grinding pins.

BACKGROUND TO THE INVENTION

A grinding machine for grinding discs is disclosed in WO97/48522 and incorporated herein by reference. WO97/48522 discloses use of a metal-bonded CBN or diamond wheel on a grinding machine to rough grind the edge of a disc, such as a semiconductor wafer, before use of a softer resin-bonded CBN wheel for finish grinding the disc edge and further describes an in situ technique for forming and re-forming a groove in the resin bonded CBN grinding wheel to grind the correct shape around the disc edge.

The machine also includes a small diameter grinding pin for grinding a notch of predetermined proportions around the edge of the ground disc.

The use of a resin-bonded CBN wheel for notch grinding has the disadvantage that such wheels are relatively soft compared with metal-bonded CBN or diamond wheels, and as such wear rapidly and need to be replaced frequently. Therefore such wheels have tended not to be used in such applications although the reduced damage to the workpiece resulting from the use of such wheels means that it is desirable if they could be used for notch grinding.

The present invention aims to provide a formable grinding pin for notch grinding which can be used for longer before it has to be replaced, and to a method of forming such a notch grinding pin and to an improved method of notch grinding.

SUMMARY OF THE INVENTION

According to one aspect of the present invention, a grinding pin for notch grinding comprises a cylindrical region of formable grinding material, in which is formed a groove having a profile which corresponds to that desired for an edge of a notch to be forced, and wherein the axial extent of the cylindrical region is such that further grooves may be formed subsequently therein as the first and then each of the other grooves becomes too worn to be capable of being reformed, and reused.

The invention thus provides a notch grinding pin, or wheel, whose axial width is such as to enable a plurality of grooves successively to be machined therearound for notch grinding.

The advantage of the invention is obtained if the formable pin is mounted in a spindle of a grinding machine and is initially formed, and re-formed as required, in situ.

Desirably the formable material comprises a resin-bonded material, or a vitreous-bonded material, such as grinding grit bonded by a resin or vitreous material.

Preferably the grinding machine is a CNC grinding machine.

Using a wide (cylindrical) pin and forming and re-forming the grooves in situ, allows more grinding operations to be performed before the pin has to be replaced. Thus after each groove formed around the cylindrical surface of the pin is no longer capable of being reformed to accurately grind notches, a further groove can be formed at an axially spaced location across the width of the pin, so increasing the useful life of the pin and reducing the number of times the more complex operation of replacing the pin (involving considerable machine down-time) is required.

The length of the cylindrical region is typically of the order of 10 mm, preferably 6 mm, and its overall diameter is typically 4 mm.

In a method of notch grinding in accordance with the invention, a first groove is formed around a cylindrical region of a formable grinding material using a groove-forming grinding wheel also mounted on the same grinding machine, and after grinding to form one or more notches, or as required, the notch-forming groove is reformed using the same, or another, forming wheel, until it is not possible to accurately re-form the groove, after which a subsequent groove is formed in a similar manner in the cylindrical surface adjacent the first, to permit the notch grinding process to continue.

In a preferred embodiment of the invention, the cylindrical region of the grinding pin may comprise the formable grinding material region, and a metal-bonded grinding material region, wherein the metal-bonded region is provided with a groove for rough grinding a notch, and the formable grinding material region is formed with a groove to permit finish grinding of a notch previously formed by the groove in the metal-bonded region of the pin, and the axial extent of the formable grinding material region is sufficient to permit additional grooves to be formed therein as each groove becomes unusable.

According to a further aspect, the invention also relates to a machine having a work spindle, a grinding spindle having a small diameter notch-forming grinding pin as aforesaid mounted thereon and engageable with an edge region of a workpiece carried by the work spindle, and a forming wheel mounted on and rotatable by a spindle which when engaged with the notch grinding pin, will form a notch-forming groove therearound as required.

The notch grinding pin is preferably formed from formable grinding material but may also comprise a first region of metal bonded grinding material also formed with a notch grinding groove, to allow rough grinding of the metal to be performed first, and thereafter the formable region to be used to finish grind the notch.

The forming wheel may be mounted on the same spindle as the workpiece, and the notch forming pin is moved as required to engage the forming wheel or the workpiece edge.

It has been found that formable notch grinding pins, formed on the machine (in situ), produce a better finish in, and less sub-surface damage around, the notch.

Preferably the grinding material is resin-bonded diamond, or resin bonded CBN, or vitreous bonded material.

The invention also lies in disc-shaped workpieces with at least one notch around their edge having an internal edge profile formed at least in part using a formable grinding pin having a grinding groove formed therein by in situ forming on the machine by a forming wheel mounted for rotation on the workspindle of the machine.

The invention will now be described by way of example, with reference to the accompanying drawings, in which.

DESCRIPTION

Figure 1:
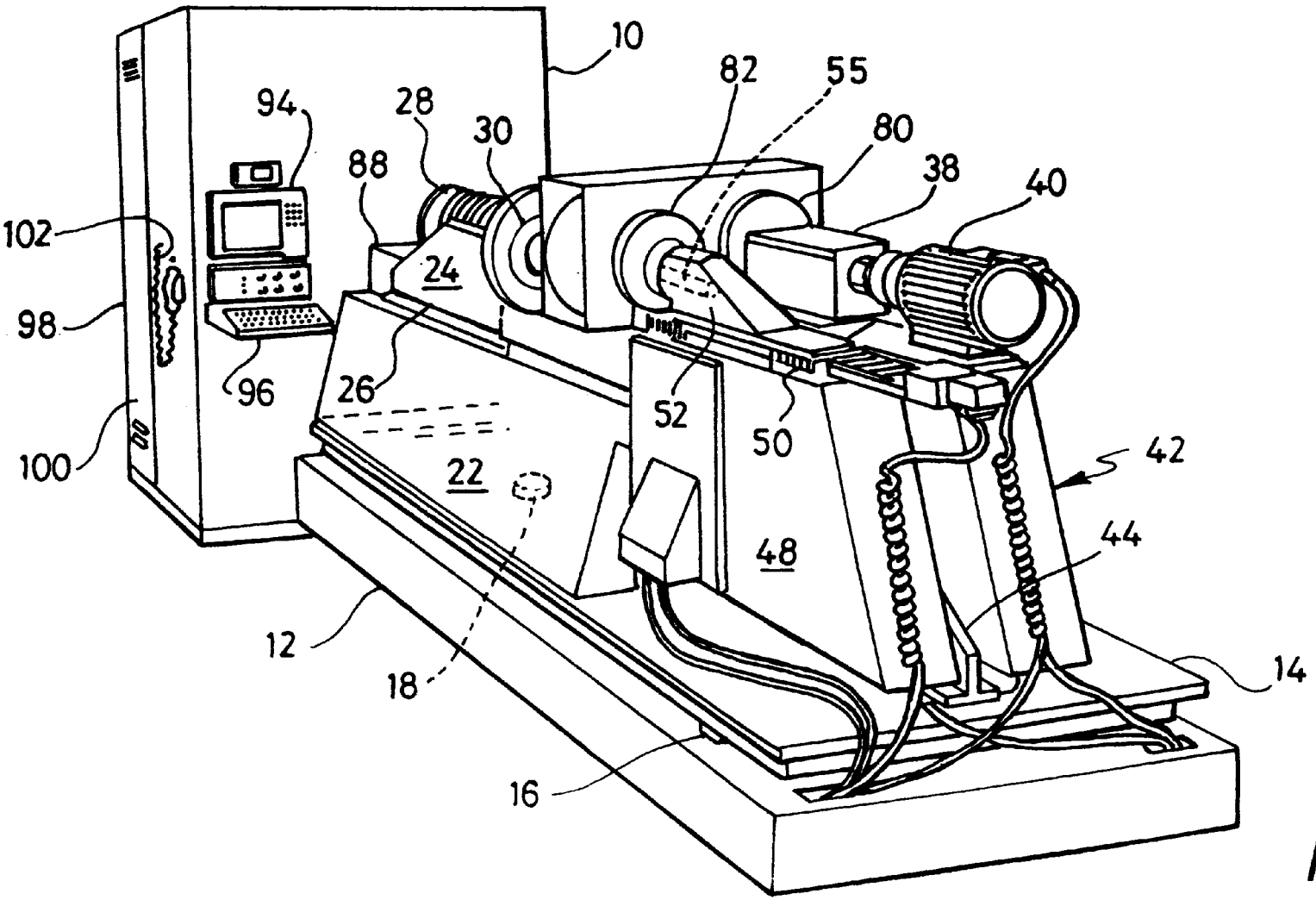
FIG. 1 is a perspective view, not to scale, from the side on which a user normally stands of a grinding machine incorporating a formable grinding pin carried on a spindle.
Figure 2:
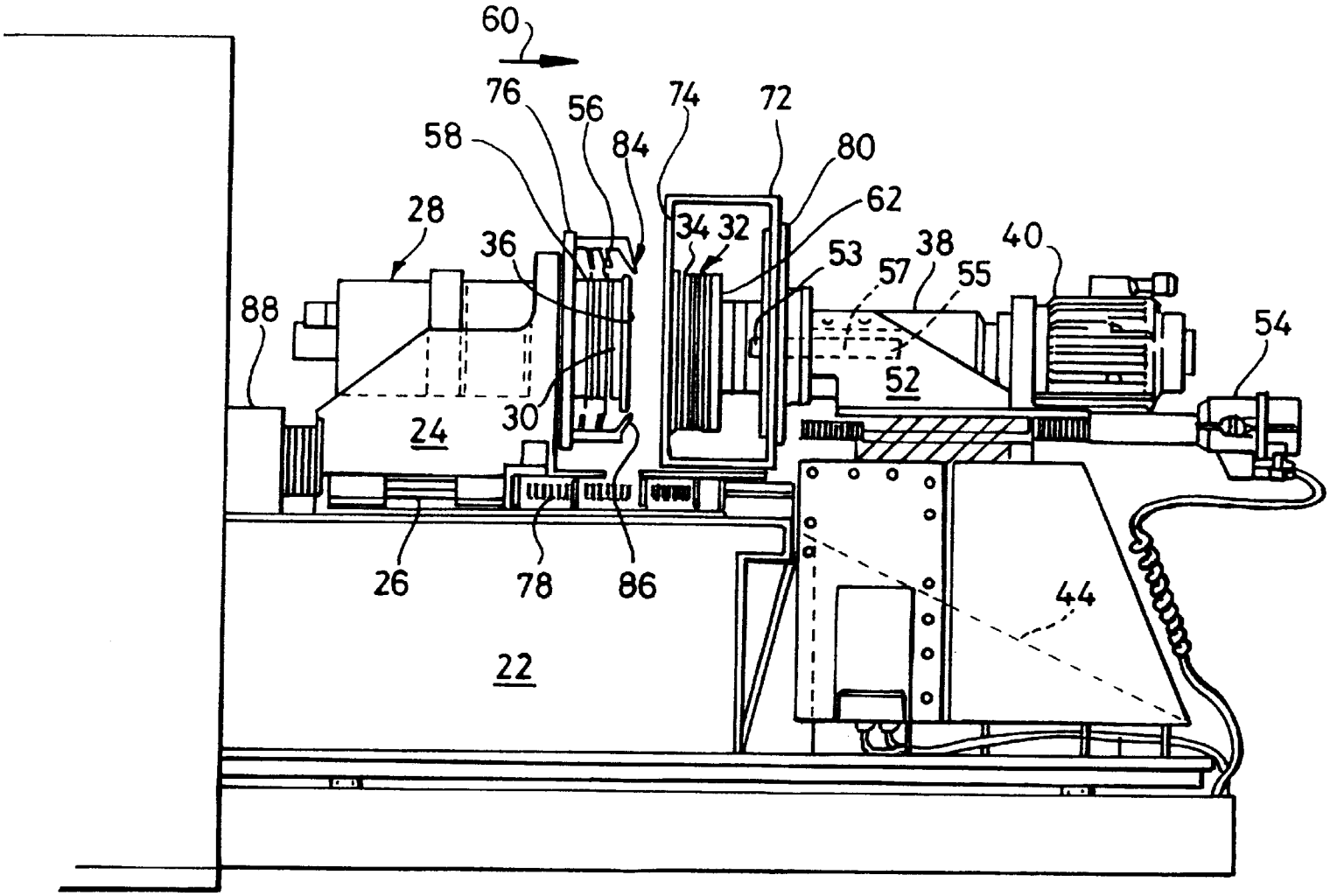
FIG. 2 is a side view, not to scale, from the side on which a user normally stands of the machine shown in FIG. 1, and illustrating a sub-assembly.
Figure 3:
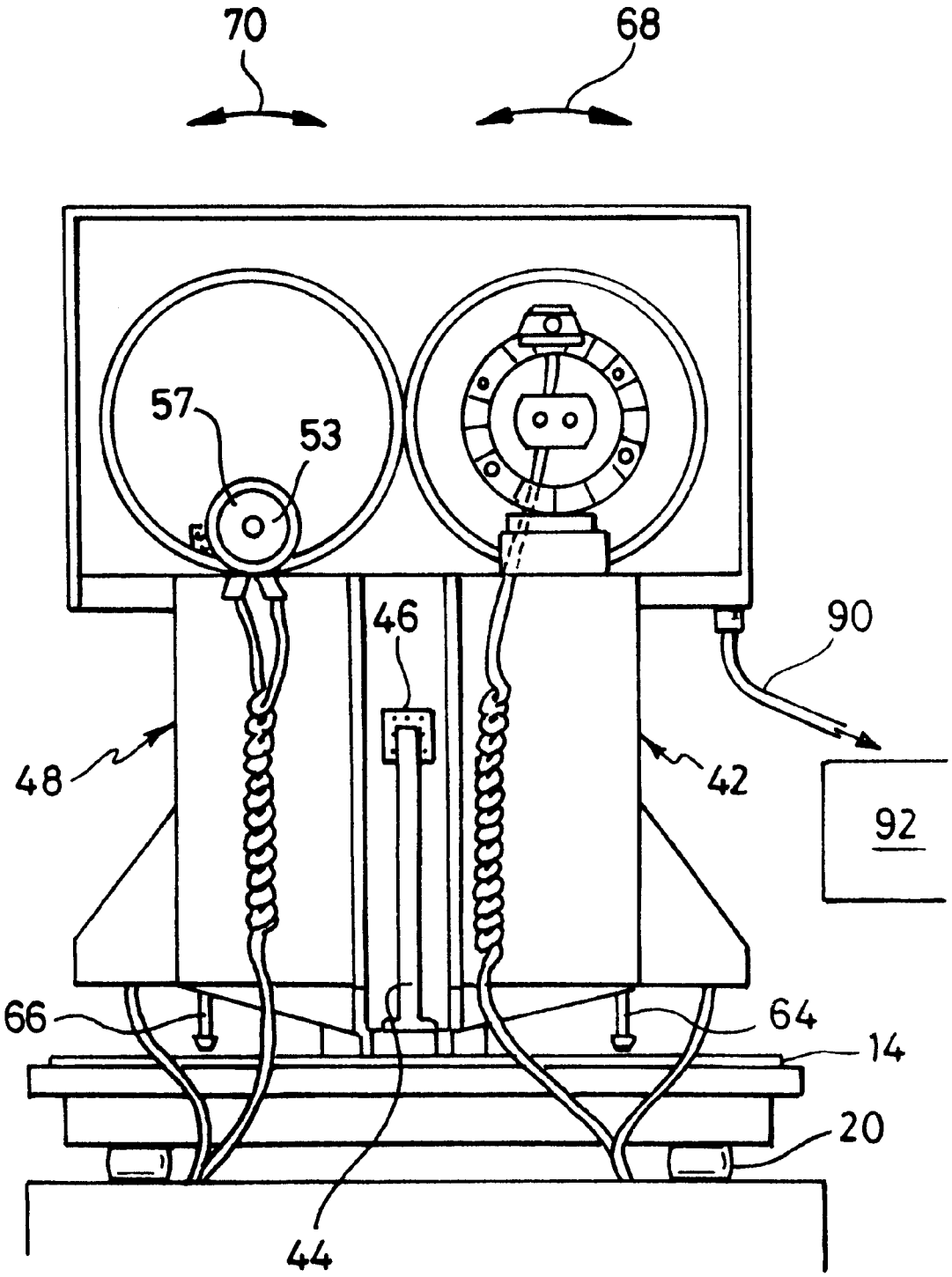
FIG. 3 is an end view of the machine shown in FIGS. 1 and 2.

FIGS. 1, 2 and 3 illustrate pictorially part of an overall machine station for notch grinding circular discs (wafers) of silicon or similar material.

The machine shown in FIGS. 1 to 3 comprises a control cabinet 10 from which extends a machine bed 12 which carries a floating platform 14 carried on three vibration absorbing feet, one of which can be seen in FIG. 1 at 16 and the second part 18 is mounted centrally before the base region 22 and is shown in dotted outline in FIG. 1, and the third can be seen at 20 in FIG. 3.

The platform 14 includes an integral support structure or base 22 which carries a workhead 24 which is slidable axially along a slideway 26 mounted on an upper surface of the base 22 and which includes a spindle drive motor 28 and vacuum chuck 30 for carrying wafers to be ground.

Edge grinding is achieved by means of a grinding wheel 32 containing a number of annular grooves such as 34 for engaging the edge of a wafer workpiece designated in FIG. 2 at 36.

The grinding wheel spindle (not shown) carried in bearing assembly 38 is rotated by an electric motor 40.

Items 38 and 40 are carried on a support generally designated 42 which is mounted close to the centre line of the platform 14 to one side of a rigid strengthening plate 44 which is bolted through flanges to the platform 14 along its base and is secured at its upper end by bolts through another flange 46 to the machine base 22. The function of the plate 44 is to increase the rigidity of the platform 14 relative to the base 22 and resist transverse vibrations which might otherwise be introduced.

Equidistant from and on the other side of the plate 44 is a second support 48 which carries a slideway 50 on which is mounted a second spindle drive 52 which carries a notch grinding spindle 57 having a notch grinding pin 53 at one end, and associated spindle motor 55.

Axial movement of the spindle drive 52 is provided by a drive unit 54 (see FIG. 2). The spindle drive 52 can also be used to grind the internal diameter of an annular disc.

The workhead edge grinding and notch grinding spindles are mounted in air bearings and the workhead spindle typically has a speed range of 2 to 1000 revs per minute, the edge grinding spindle typically has a speed range up to 6000 revolutions per minute and the speed of the notch grinding spindle 53 is typically up to 70,000 revolutions per minute.

On the workhead spindle to the rear of the chuck 30 are mounted forming wheels best seen in FIG. 2 at 56 and 58. Indexing the workhead 24 in the direction of the arrow 60 in FIG. 2 allows the workpiece disc 36 to be engaged by one of the slots such as 34 in the grinding wheel 32 and further movement in the direction of the arrow 60 allows the disc 36 to clear the end face 62 of the grinding wheel assembly and to allow the forming wheels 56 or 58 to engage in the appropriate grooves in the grinding wheel 32.

Lateral movement of the grinding wheel or notch grinder as required is achieved by tilting the support structures 42 and 48 as appropriate relative to the platform 14. To this end both of the structures 42 and 48 are pivotally attached to the platform 14 near the centre line thereof and two stops 64 and 66 respectively (see FIG. 3) prevent excessive outward movement.

The pivoting is provided by means of flexures (as will be described) which allow for pivoting movement about two parallel axes close to the centre line of the platform 14 so that structure 42 can describe a small arc such as denoted by arrow 68 and structure 48 can describe an arc as denoted by reference numeral 70.

Drive means for achieving the pivoting movement will be described with reference to later figures.

Attached to the base 22 is a clear polycarbonate rectilinear housing 72 through which the grinding wheel spindle protrudes. A large, generally oval opening 74 in the face of the housing 72 allows a similarly shaped closure 76 mounted on the workhead 24 to enter and seal off the opening 74 upon appropriate forward movement of the workhead 24 in the direction of the arrow 60 as aforesaid.

An inflatable ring seal 78 around the closure 76 (or alternatively around the internal lip of the opening 74) provides for a fluid tight seal between the closure 76 and the opening 74.

The housing 72 is slidable relative to the base 22 and bellows seals 80 and 82 are provided between the spindle drives 38 and 52 so that after the seal has been made between the closure 76 and the opening 74, the housing 72 will in fact move axially with the workhead assembly 24. Sufficient clearance is provided to the rear of the bellows to allow the housing 72 to move in a continuing sense in the direction of the arrow 60 to allow for the grooves in the grinding wheel to be formed. Movement in the opposite sense is also accommodated by the bellows 80 and 82 so that the closed housing 72 can also follow the workhead 24 as it moves in an opposite sense to that of arrow 60 to allow for the edge of the disc 36 to be engaged by one of the grinding grooves such as 34.

Coolant fluid is sprayed onto the workpiece through nozzles 84 and 86 and similar nozzles are provided for spraying similar fluid onto the forming wheels when required. An interlock is provided to prevent coolant fluid being jetted unless the housing 72 is closed and sealed by the closure 76.

After a grinding operation has been completed and after a final wash with fluid, the housing 72 can be opened by deflating the edge seal 78 and withdrawing the workhead 24 in a direction opposite to that of arrow 60 to the position shown in FIG. 2. The finished workpiece 36 can then be demounted and a fresh workpiece installed.

Wheel forming/dressing

Wheel forming can be performed initially before any workpiece has been mounted, in which case the housing 72 is closed by appropriate movement of the workhead 24 and closure 76 without first mounting a workpiece such as 36 on the chuck 30. Wheel forming is performed by appropriate axial movement of the workhead 24 and lateral movement of support 42, so that each of the grooves, such as groove 34, is engaged by the appropriate forming wheel such as 56 or 58. Coolant fluid is provided during the wheel forming operation.

After initial wheel forming, the assembly may be separated by breaking the seal 78 as before mentioned. After mounting a workpiece 36, the assembly can be closed again and grinding undertaken as before described.

Typically re-forming of the groove is performed during machine downtime after one workpiece has been removed and before a subsequent workpiece has been installed, but in a development of the machine in which edge profile checking of the workpiece 36 is performed in situ on the workhead, it may be advantageous to allow for re-forming with the workpiece in place.

Notching

If a workpiece is to be notched, the support 42 is moved laterally to disengage the wheel from the workpiece and support 48 is moved laterally instead so as to engage the edge of the workpiece 36 by the notching pin 53. After notching, the support 48 is moved in an opposite sense so as to disengage the pin from the workpiece.

Polishing

In an alternative arrangement, a polishing wheel may be mounted on the wheel spindle as well as the grooved grinding wheel, and by axially shifting the workpiece spindle, so the polishing wheel can be brought into engagement with the edge of the workpiece 36.

A drive for shifting the workhead 24 along the slideway 26 is provided at 88.

As shown in FIG. 3, a drainpipe 90 conveys fluid from the housing 72 to a storage tank 92 and a pump (not shown) is provided to recirculate the fluid from the tank. A filter may be provided in the tank or in the line between the tank and the pump.

The control housing 10 includes a television display 94 and keyboard 96 and a hand-held control unit 98 is connected via a flying lead 100 to a connection plug 102. An operator can remove the unit 98 and walk to the machine with the unit 98 in his hand, and by pressing appropriate buttons instigate or arrest operation of the machine. The housing 10 houses a computer based control system for supplying control signals and power to the drives on the machine and for receiving signals from transducers, switching and other position/operation/touch etc signal generating sensors on the machine.

The slideway 26 on which the workhead slides, is preloaded, and the workhead is driven by server motors and fitted with a high resolution position coder to provide smooth motion during axis move interpolation.

Grinding infeed is achieved as previously described by tilting the structures 42 or 48 as required to bring the grinding element carried thereon into engagement with the edge of the workpiece 36. Although the movement is not truly linear, but arcuate, this can be accommodated in the control signals generated by the control system housed within the housing 10.

Whilst the jets such as 84 and 86 can be used to supply cutting fluid during grinding, they or other jets may be used to direct jets of cleaning fluid at the overhanging lip of the wafer whilst it is still being rotated but after grinding. This prevents grinding swarf from running down the back face of the wafer as it is removed from the chuck.

Grinding process

Typically edges are ground in a two-stage process using a plunge grind roughing operation and a second plunge grind finish cycle which includes a rapid advance of the grinding wheel until a touch sensor detects contact with the workpiece wafer. The grinding wheel axis position at touchdown is used to monitor wheel wear and to ensure that the material removed per finish cut cycle is kept constant. Grinding wheelforms are maintained by using metal-bonded diamond forming wheels permanently mounted on the workhead chuck. The reforming process can be fully automatic and can be programmed to occur every nth wafer, or whenever the ground edge profile becomes unacceptable (as determined by optical inspection of the disc edge profile) or when the touchdown point indicates excessive wheel wear.

Damping

In order to reduce unwanted vibration and resulting grinding damage to the minimum, the structural components making up the grinding machine are filled at least partially with polymer concrete, particularly sections of the base 22 and the bed 12 and if desired also the platform 14.

Subassembly flexure mounting

Figure 4:
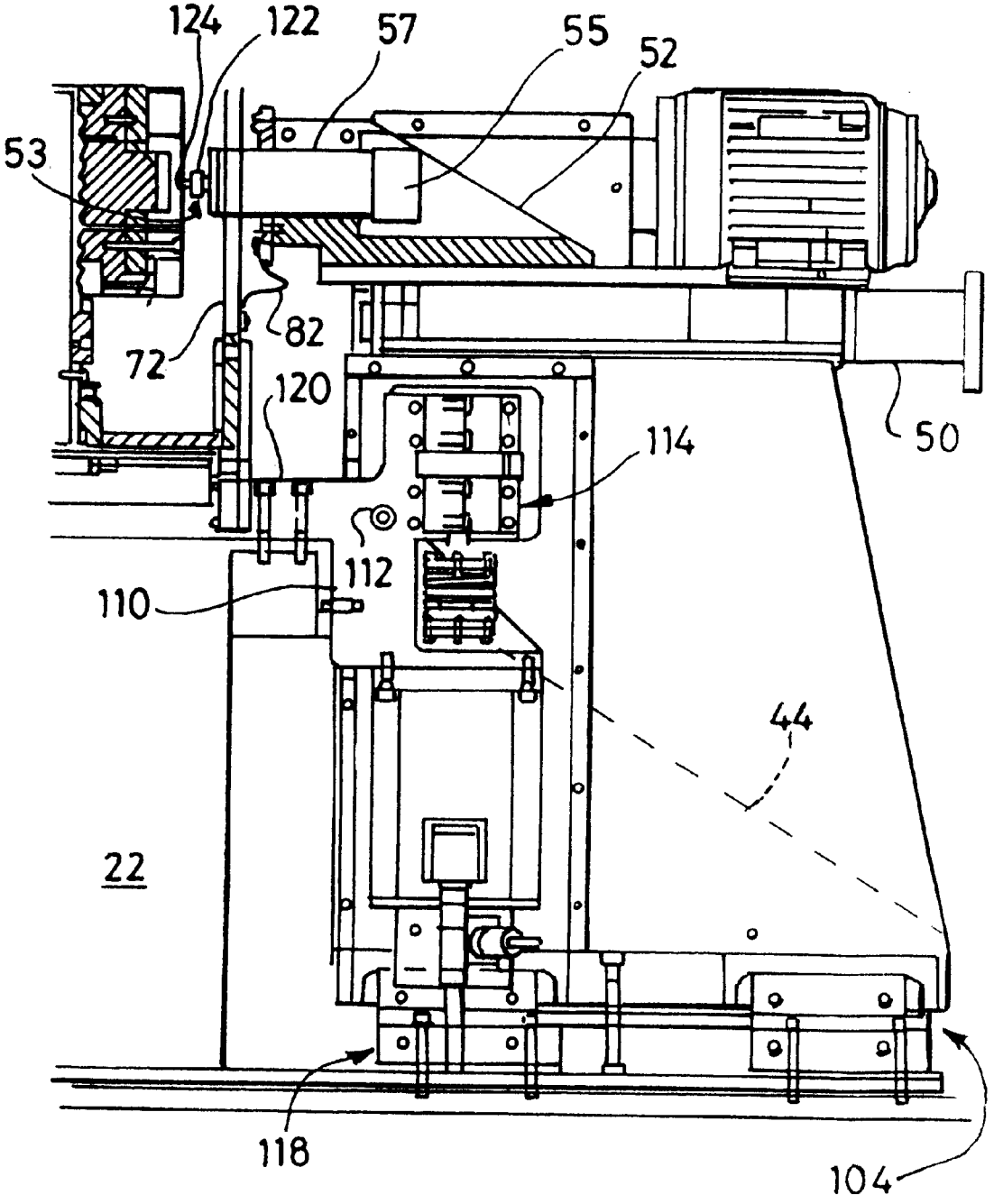
FIG. 4 is a side view of the sub-assembly end of the machine to an enlarged scale and partly in section.

FIG. 4 illustrates how the two structures 42 and 48 are mounted for hinging movement to permit wheel infeed. As shown in FIG. 4, the inboard edges of the two structures 42 and 48 are connected to the platform 14 by means of flexures (sometimes referred to as strip-hinges) one of which is shown at 104. A second pair of flexures are provided towards the other end of the structures 42 and 48 nearer to the machine base 22.

Whilst the flexures 102 and 104 permit tilting of the structures about one axis, they do not readily permit any other movement of the structures 42 and 48 relative to the platform 14 about any other axis. Consequently the coupling of the structures 42 and 48 to the platform 14 is very stiff in all directions except about the hinge axis of the flexures.

Cam drive

FIG. 4 is a side view of the end of the machine, albeit to a slightly reduced scale. As with the other views, it is shown partly cut-away so as to reveal the cam drive mechanism generally designated 114 which acts on the structure 48. A captive washer 112 is shown at the side of the drive mechanism.

FIG. 4 also shows the two flexure mountings at the base of the unit 48, the outboard one being designated 104 and the inboard one being designated 118.

As previously mentioned each of the cam drive arrangements is carried within a rigid housing 110 and the latter is more clearly visible in FIG. 4 as is the horizontal leg 120 by which it is bolted to a protruding plate from the end of the base 22.

Also visible in FIG. 4 is the motor 55 for driving the chuck 122 from which the notch grinding spindle 124 protrudes. The motor 55 is carried within a housing 52 previously described in respect of FIG. 1, and the housing 52 slides along a slideway 50 as previously described.

FIG. 4 shows the bellows seal 82 attaching the housing 52 sealingly to the opening in the casing 72 through which the motor 55 and spindle carrying pin 53 protrude.

Figure 5:
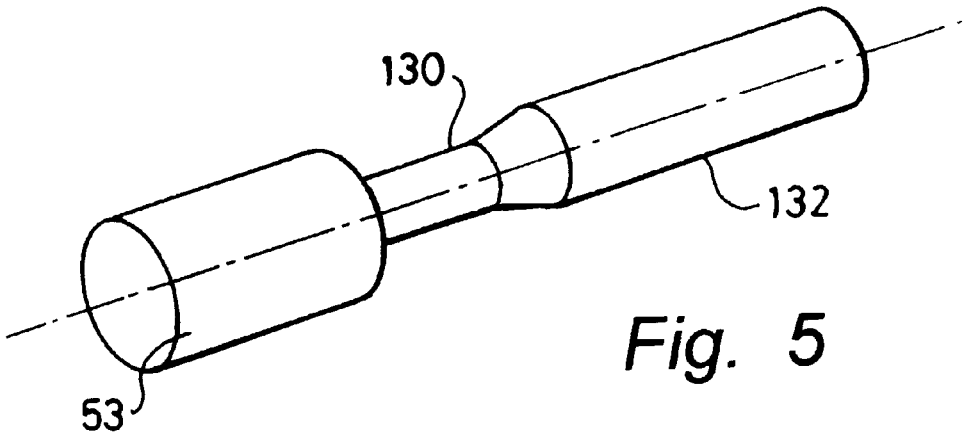
FIG. 5 is a perspective view of the formable pin.
Figure 6:
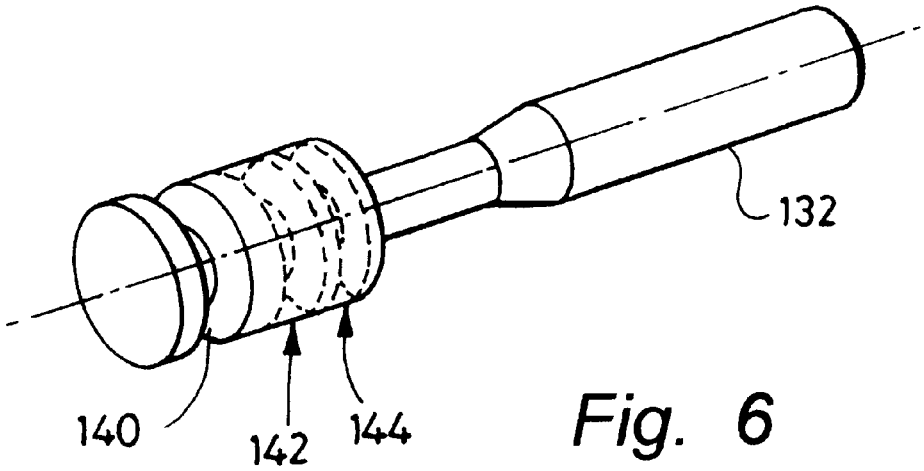
FIG. 6 is a perspective view, not to scale, of the formable pin with a first groove for notch grinding.
Figure 7:
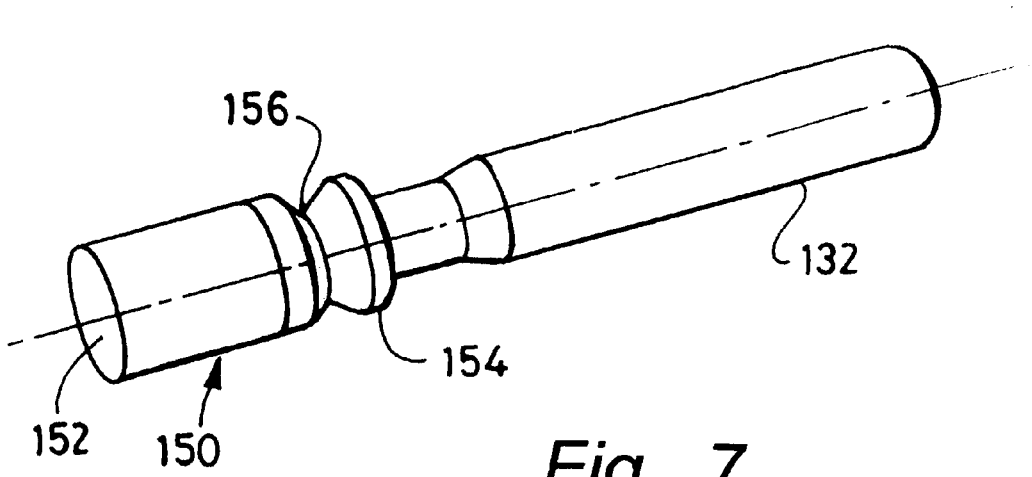
FIG. 7 is a perspective view, not to scale, of a combined formable material and metal-bonded material grinding pin.

The formable grinding pin, or wheel, 53 shown in FIG. 1 is now discussed on more detail in relation to FIGS. 5, 6 and 7.

The formable cylindrical grinding pin 53 shown in FIG. 5 is carried by a smaller diameter cylindrical metal core 130, 132 for fitting to the spindle (not shown) of a grinding machine. The cylindrical grinding pin 53 is of approximately 4 mm diameter by 6 mm axial extent in which a first groove 140 is formed in situ by a forming wheel (not shown). The cylindrical nature of the pin 53 allows a series of adjacent grooves such as 142, 144 to be machined into the grinding material region as each groove becomes worn and ceases to be operational as shown in FIG. 6.

The pin is formed of resin-bonded diamond, resin-bonded grinding grit or vitreous-bonded material.

In use, the operational groove in the resin-bonded diamond wheel 53 is brought into contact with the edge of a stationary semi-conductor disc (not shown) to grind a notch in the disc edge. To this end, the pin 53 is rotated at speeds of the order of 30,000 rpm or more.

After several notch grinding operations (and re-forming to the extent permitted by material and depth considerations) the groove in use (eg 140) wears out, and another groove (eg 142), is formed into the resin so that notch grinding can continue without the need to demount and replace the pin 53. Typically a total of three or four grooves can be formed along the pin 53 before it has to be replaced. Whilst use of a cylindrical pin permits several grooves to be cut, increasing the axial length to allow even more grooves to be cut, increases the risk of whip, and the risk of errors occurring in the grinding of the notch.

The use of an elongated resin-bonded or vitreous-bonded pin thus allows for a succession of different grooves to be formed in the pin as each groove in turn wears out, and this reduces the number of times the pin 53 must be replaced. Each groove can be reformed a few times before it becomes too deep, and/or break-through occurs into the core material 130.

Although not shown, the groove-forming grinding wheel may to advantage be mounted on the workspindle carrying the workpiece in which a notch is to be ground.

When the pin is being used on a CNC grinding machine, the latter can be programmed automatically to calculate the diameter of the root of the groove in the notch grinding wheel and compensate by interpolation to produce the desired form of notch during the grinding process.

A further embodiment of the invention is shown in FIG. 3, where a composite grinding pin 150 is provided. Here the resin-bonded diamond section 152 is integral with or simply abuts an axially adjacent metal-bonded diamond section 154. In use, a groove 156 in the metal bonded section 154 is used to rough grind the bulk of each notch, and finish grinding occurs during a second pass, using the current groove formed in the resin-bonded diamond section 152.

The metal-bonded section is preferably designed to outlive the expected useful life of the resin-bonded section so that replacement or reforming of the rough grinding groove 156 is not necessary. Should reforming be necessary, a tougher metal-bonded forming wheel or more preferably a diamond forming wheel will be required to reform the rough-grinding section groove 156. Preferably any such reforming of the groove in the metal-bonded section is also done in situ in the machine, using an appropriately mounted forming wheel, which is preferably mounted on the workspindle.

A CNC grinding machine such as described in WO97/48522 may be used to mount the notch grinding pin and the groove forming wheels.

What is claimed is:

1. A grinding pin for notch grinding, the grinding pin comprising a cylindrical region of formable grinding material, in which is formed a groove having a profile which corresponds to that desired for an edge of a notch to be formed, and wherein an axial extent of the cylindrical region is such that further grooves can be formed subsequently therein as a first and then each of the other grooves becomes too worn to be capable of being reformed, and reused.

2. A grinding pin according to claim 1, wherein the cylindrical region has a length of 10 mm.

3. A grinding pin according to claim 1, wherein the cylindrical region has a length of 6 mm and a diameter of 4 mm.

4. A grinding pin according to claim 1, wherein the formable grinding material comprises grinding grit bonded by a resin material.

5. A grinding pin according to claim 1, wherein the cylindrical region comprises the formable grinding material region and a metal-bonded grinding material region, wherein the metal-bonded region is provided with a groove for rough grinding a notch, and the formable grinding material region is formed with a groove to permit finish grinding of a notch previously formed by the groove in the metal-bonded region of the wheel, and the axial extent of the formable grinding material region is sufficient to permit additional grooves to be formed therein as each groove becomes unusable.

6. A grinding machine having a work spindle and a grinding spindle with a grinding pin according to claim 1 mounted thereon and engageable with an edge region of a workpiece carried by the work spindle, and a forming wheel mounted on and rotatable by a spindle which engages with the grinding pin to form a groove therearound.

7. A grinding machine according to claim 6, wherein the forming wheel is mounted on the same spindle as the workpiece, and the grinding pin is moveable to engage the forming wheel.

8. A grinding machine according to claim 6, wherein the grinding machine is a CNC grinding machine.

9. A grinding machine including a grinding pin in accordance with claim 1.

10. Use of a grinding pin according to claim 1 in the manufacture of disc-shaped workpieces with at least one notch around their edge.

11. A grinding pin according to claim 1, wherein the formable grinding material comprises grinding grit bonded by a vitreous material.

* * * * *